US007007470B2

(12) United States Patent
Langenfeld et al.

(10) Patent No.: US 7,007,470 B2
(45) Date of Patent: Mar. 7, 2006

(54) COMPRESSION RELEASE VALVE

(75) Inventors: Christopher C. Langenfeld, Nashua, NH (US); Scott W. Newell, Ipswich, MA (US); Thomas S. Schnellinger, North Andover, MA (US)

(73) Assignee: New Power Concepts LLC, Manchester, NH (US)

( * ) Notice: Subject to any disclaimer, the term of this patent is extended or adjusted under 35 U.S.C. 154(b) by 0 days.

(21) Appl. No.: 11/054,352

(22) Filed: Feb. 9, 2005

(65) Prior Publication Data

US 2005/0188674 A1 Sep. 1, 2005

Related U.S. Application Data

(60) Provisional application No. 60/542,926, filed on Feb. 9, 2004.

(51) Int. Cl.
*F01B 29/10* (2006.01)

(52) U.S. Cl. ..... 60/521; 123/182.1

(58) Field of Classification Search ..... 60/517, 60/521, 522; 123/182.1
See application file for complete search history.

(56) References Cited

U.S. PATENT DOCUMENTS

| | | | |
|---|---|---|---|
| 55,516 | A | 6/1866 | Winans et al. |
| 120,222 | A | 10/1871 | Van Emon |
| 124,805 | A | 3/1872 | Fryer |
| 321,313 | A | 6/1885 | Pinkham |
| 488,373 | A | 12/1892 | Touch |
| 646,406 | A | 4/1900 | Anderson et al. |
| 1,089,651 | A | 3/1914 | Kovalavich |
| 1,769,375 | A | 7/1930 | Leary |
| 1,831,574 | A | 11/1931 | Norton |
| 1,840,389 | A | 1/1932 | Eubank |
| 1,866,702 | A | 7/1932 | Gehres |
| 2,170,099 | A | 8/1939 | Stubings |
| 2,176,657 | A | 10/1939 | Finch |
| 2,289,984 | A | 7/1942 | Mouromtseff et al. |
| 2,337,294 | A | 12/1943 | Cooper |
| 2,419,234 | A | 4/1947 | Holihan |

(Continued)

FOREIGN PATENT DOCUMENTS

| | | |
|---|---|---|
| DE | 445033 | 5/1927 |

(Continued)

OTHER PUBLICATIONS

Eder, F., *Apparatus for Heat Transfer at Elevated Temperature, to the Working Medium of a Regenerative Thermal Engine (or "energy engine")*.

(Continued)

*Primary Examiner*—Hoang Nguyen
(74) *Attorney, Agent, or Firm*—Bromberg & Sunstein LLP

(57) ABSTRACT

An electromechanical compression release valve for compressors, engines with rotary or reciprocating mechanisms and external combustion engines, such as, a Stirling cycle engine, reduces the engine starting power by reducing the compression pressure in the cylinder head space area. The valve reduces the compression pressure by passing the working fluid from the cylinder head space to another compartment. The valve comprises a housing, a valve member, a valve-driving member, a valve position sensor, and a ratchet pawl. In the open position, and while starting the engine, the inlet of the rotatable valve member is aligned with the opening in a chamber connected to the engine work space, thus, the working fluid passes through the valve member into the crankcase. After the engine starts, the valve position sensor directs the valve-driving member to rotate the valve member to the closed position. When closed, the engine working fluid can now achieve the operating compression pressures.

10 Claims, 4 Drawing Sheets

U.S. PATENT DOCUMENTS 2,564,100 A 8/1951 Du Pré
2,595,457 A 5/1952 Holm et al.
2,688,228 A 9/1954 De Brey et al.
3,059,418 A 10/1962 Johnston
3,293,480 A 12/1966 Green et al.
3,431,788 A 3/1969 De Pré et al.
3,496,922 A * 2/1970 Campen ..... 123/182.1
3,742,578 A 7/1973 Dirne et al.
3,775,973 A 12/1973 Hudson
3,782,457 A 1/1974 Troy
3,860,384 A 1/1975 Vulliet et al.
3,861,223 A 1/1975 Braun
3,924,477 A 12/1975 Portelance
3,940,933 A 3/1976 Nystrom
3,956,892 A 5/1976 Nystrom
4,008,039 A 2/1977 Compton et al.
4,020,635 A 5/1977 Joynes et al.
4,041,592 A 8/1977 Kelm
4,067,191 A 1/1978 Gronvall et al.
4,085,588 A 4/1978 Reams et al.
4,169,692 A 10/1979 McDonough et al.
4,172,363 A 10/1979 Bex
4,191,241 A 3/1980 Brennan
4,231,222 A 11/1980 Fenton
4,305,457 A 12/1981 Cozzolino
4,313,080 A 1/1982 Park
4,330,260 A 5/1982 Jorgensen et al.
4,330,992 A 5/1982 Senft
4,343,350 A 8/1982 Campbell et al.
4,364,724 A 12/1982 Alpkvist
4,384,457 A 5/1983 Harvey
4,387,568 A 6/1983 Dineen
4,413,475 A 11/1983 Moscrip
4,416,114 A 11/1983 Martini
4,434,617 A 3/1984 Walsh
4,442,670 A 4/1984 Goldman
4,445,570 A 5/1984 Retallick
4,511,805 A 4/1985 Boy-Marcotte et al.
4,527,394 A 7/1985 Corey
4,538,677 A 9/1985 Bodas et al.
4,573,320 A 3/1986 Kralick
4,619,228 A * 10/1986 Liu ..... 123/182.1
4,633,667 A 1/1987 Watanabe et al.
4,662,176 A 5/1987 Fujiwara et al.
4,676,202 A 6/1987 Johnson
4,736,586 A 4/1988 Kawajiri et al.
4,768,341 A 9/1988 Nozaki et al.
4,824,149 A 4/1989 Reuchlein
4,881,372 A 11/1989 Naito
4,898,041 A 2/1990 Islas
4,901,790 A 2/1990 Meijer
4,936,273 A * 6/1990 Myers ..... 123/321
4,977,742 A 12/1990 Meijer
4,996,841 A 3/1991 Meijer et al.
5,003,777 A 4/1991 Berchowitz
5,005,349 A 4/1991 Momose et al.
5,065,579 A 11/1991 Monahan
5,074,114 A 12/1991 Meijer et al.
5,095,701 A 3/1992 Nakano
5,148,066 A 9/1992 Beale et al.
5,174,117 A 12/1992 Naito et al.
5,184,586 A * 2/1993 Buchholz ..... 123/182.1
5,199,722 A 4/1993 Wada et al.
5,203,170 A 4/1993 Naito
5,228,293 A 7/1993 Vitale
5,441,401 A 8/1995 Yamaguro et al.
5,459,812 A 10/1995 Taylor
5,494,135 A 2/1996 Brackett
5,522,214 A 6/1996 Beckett et al.
5,590,526 A 1/1997 Cho
5,596,262 A 1/1997 Boll
5,642,618 A 7/1997 Penswick
5,675,974 A 10/1997 Heikrodt et al.
5,697,430 A 12/1997 Thors et al.
5,701,859 A * 12/1997 Edlund ..... 123/182.1
5,735,681 A 4/1998 Cheng
5,743,091 A 4/1998 Penswick et al.
5,755,100 A 5/1998 Lamos
5,761,985 A 6/1998 Stoll
5,771,694 A 6/1998 Houtman et al.
5,786,640 A 7/1998 Sakai et al.
5,804,947 A 9/1998 Nii et al.
5,864,770 A 1/1999 Ziph et al.
5,875,863 A 3/1999 Jarvis et al.
5,878,570 A 3/1999 Reithofer
5,881,800 A 3/1999 Chung
5,920,133 A 7/1999 Penswick et al.
5,921,764 A 7/1999 Marchionna et al.
5,929,538 A 7/1999 O'Sullivan et al.
5,945,808 A 8/1999 Kikuchi et al.
5,952,813 A 9/1999 Ochiai
5,954,039 A 9/1999 Doering et al.
6,050,092 A 4/2000 Genstler et al.
6,062,023 A 5/2000 Kerwin et al.
6,094,912 A 8/2000 Williford
6,161,381 A 12/2000 Lohrmann
6,161,610 A 12/2000 Azar
6,247,310 B1 6/2001 Norris et al.
6,253,550 B1 7/2001 Langenfeld et al.
6,318,068 B1 * 11/2001 Shaw ..... 60/39.6
6,347,453 B1 2/2002 Mitchell
6,381,958 B1 5/2002 Kamen et al.
6,543,215 B1 4/2003 Langenfeld et al.

FOREIGN PATENT DOCUMENTS

DE 1528714 3/1977
DE 35 00 124 A1 7/1986
DE 37 34 009 A1 10/1987
DE 84 11 960.8 8/1988
DE 39 34 545 A1 5/1991
DE 40 18 943 A1 12/1991
DE 41 02 306 A1 8/1992
DE 42 05 283 A1 8/1993
DE 42 19 583 A1 12/1993
DE 43 08 888 A1 7/1994
DE 295 20 864 U 1 5/1996
DE 198 20 192 A1 11/1998
EP 0 458 115 A1 5/1991
EP 0 607 154 B1 7/1992
FR 1063612 12/1953
FR 2 067 119 8/1971
FR 2 609 154 7/1988
FR 2 721 982 6/1994
GB 395374 7/1933
IT 500313 11/1954
JP 55037540 3/1980
JP 58-25556 8/1981
JP 56-133597 10/1981
JP 58117995 7/1983
JP 61128024 6/1986
JP 63068759 3/1988
JP 02021123 1/1990
JP 02091463 3/1990
JP 02256856 10/1990
JP 03009058 1/1991
JP 04347410 12/1992
JP 07151402 6/1995
JP 07293334 11/1995

| | | |
|---|---|---|
| JP | 09015197 | 1/1997 |
| NL | 675161 | 7/1952 |
| NL | 689484 | 3/1953 |
| NL | 704002 | 2/1954 |
| NL | 892962 | 4/1962 |
| WO | WO 90/08891 | 8/1990 |
| WO | WO 91/05949 | 5/1991 |
| WO | WO 99/40310 | 8/1999 |
| WO | WO 00/79114 A1 | 12/2000 |

OTHER PUBLICATIONS

Hargreaves, *"The Regnerator":, The Phllip's Stirling Engine*, 1991.

*AAVID Thermal Technologies, Inc.*, Product Selection Guide, Jan. 1996.

Fleming, F. et al, *Rapid Recharge Capability of Valve Regulated Lead Acid Batteries for EV & HEV Applications*.

Anderson, C. et al., *The Effects of APU Characteristics on the Design of Hybrid Control Strategies for Hybrid Electric Vehicles, SAE Technical Paper Serie* , Feb. 27-Mar. 2, 1995.

Dickinson, et al., *Performance, Management and Testing Requirements for Hybrid Electric Vehicle Batteries, SAE Technical Paper Series*, Aug. 11-13, 199165.

Hochgraf, C., et al., *Engine Control Strategy for a Series Hybrid Electric Vehicle Incorporating Load-Leveling and Computer Controlled Energy Management, SAE Technical Paper Series*,, Feb. 26-29, 1996.

Oman, H., *New Energy Management Technology Gives Hybrid Cars Long Battery Life, SAE Technical Paper Series*, Aug. 2-5, 1999.

Hobbs, R. Development of Optimized Fast Charge Algorithms for Lead Acid Batteries; *SAE Technical Paper Series*, Mar. 1-4, 1999.

Wiegman, H., *Battery State Control Techniques for Charge Sustaining Applications, SAE Technical Paper Series*, Feb. 23-26, 1998.

* cited by examiner

COMPRESSION RELEASE VALVE

This application claims priority from U.S. provisional patent application Ser. No. 60/542,926, filed Feb. 9, 2004, entitled "Compression Release Valve for an External Combustion Engine," which is incorporated herein by reference in its entirety.

BACKGROUND

Generally, combustion engines must be initially turned over using other energy sources. During startup of reciprocating engines, the movement of the pistons or crankshaft assembly creates a compression pressure in the cylinder head space. A substantial crankshaft torque is required to produce this compression pressure to start the engine. The same principle applies to starting compressors.

External combustion machines, for example Stirling cycle machines including engines and refrigerators, have a long technical heritage. Walker, *Stirling Engines*, Oxford University Press (1980), describing Stirling cycle engines in detail, is incorporated herein by reference. The principle underlying the Stirling cycle engine is the mechanical realization of the Stirling thermodynamic cycle: isovolumetric heating of a gas within a cylinder, isothermal expansion of the gas (during which work is performed by driving a piston), isovolumetric cooling, and isothermal compression.

To start a Stirling engine, the working fluid in the cylinder head must be compressed to a relatively high pressure. The energy required to compress the working fluid is higher than the net thermal energy that is transformed into mechanical energy on a given cycle of the engine. Consequently the starting torque is much greater than the operational output torque of the engine. Such comparatively large demands during start-up may require the use of higher power rated starting motor and associated electronics that increase the overall energy cost to the system.

Traditionally, devices such as compression release valves have been used to reduce the required starting torque by reducing the compression pressure. Such compression release valves work by reducing the compression pressure in the cylinder head space while the engine is started, and restoring the compression pressure after the engine has started. When a compression valve is opened, some of the engine working fluid can be released from the compression chamber, thus reducing the cylinder head compression pressure and allowing the engine to turn over with less torque. When the engine starts, the valve is closed and the compression pressure is restored.

Traditional compression valves, such as electrically controlled valves with poppet construction with a solenoid actuator and a spring return, do not address the need of external combustion engines that require high working fluid flow and high bi-directional pressures. If such traditional valves are to be used in external combustion engines with high working fluid flow and high bi-directional pressures, the valves will require relatively large spring returns, and correspondingly high power demands for the efficient transfer of the fluids. Furthermore, such valves are not usually amendable to controlled precision closing required for certain applications. Accordingly, the requirements of low engine starting torque and the need for precision control of valve closing, in combination with the size and power demands of such traditional valves, make such valves impractical and inadequate for certain applications in external combustion engines.

There is therefore the need for valves that are relatively compact with minimal power requirements, have controlled precision closing, and can efficiently transfer fluids between two compartments of the external combustion engine. Furthermore, the compression valves should be capable of operating without lubrication and over a wide temperature range with relatively minimal leakage.

SUMMARY

Accordingly, we provide an electromechanical compression release valve for compressors, engines with rotary or reciprocating mechanisms, and an external combustion engine. Certain embodiments of this compression release valve are capable of precise electronic control to enable the gradual closing of the valve and have a relatively low friction mechanism. Other embodiments of the invention can remain in the prescribed open or closed position without substantial valve member drift and can transfer fluids, efficiently and with minimal flow resistance, between two compartments.

In one embodiment, the compression release valve comprises a housing, a valve member, a valve-driving member, and a valve position sensor. The housing includes a chamber that is in communication with the compression space of the engine such as the cylinder head space of the engine. An opening in the housing chamber connects the cylinder head space with the crankcase space when the valve is open. The shape and location of the opening permits the efficient reduction of pressure in the cylinder head space. An inlet of the rotatable valve member can be aligned with the opening of the chamber to open the valve. In the open position, the valve can reduce the magnitude of the compression pressure in the cylinder head space area when an outlet of the valve member connects the working fluid in the cylinder head space to another compartment. A valve-driving member drives the valve member to an open or closed position. In certain embodiments, the valve-driving member is an electric DC motor. In other embodiments, a valve position sensor senses the position of the valve. On sensing the valve member position, the sensor can direct the valve-driving member to drive the valve member to a desired position.

In certain embodiments, flow control elements including protrusions or indentations are part of the chamber to facilitate the efficient transfer of the working fluid from the compartment. The flow control elements may also facilitate the high flow and low resistance flow of the working fluids between the compartments.

Certain embodiments of the invention include a process for the precise control of the valve-driving member such that the valve member responds quickly and accurately to commands. Other embodiments of the invention include a ratchet pawl to prevent the valve member from drifting from the desired position due to vibration from engine operation.

BRIEF DESCRIPTION OF THE DRAWINGS

The foregoing features of the invention will be more readily understood by reference to the following detailed description, taken with reference to the accompanying drawing(s), in which.

DETAILED DESCRIPTION OF EMBODIMENTS

Figure 1:
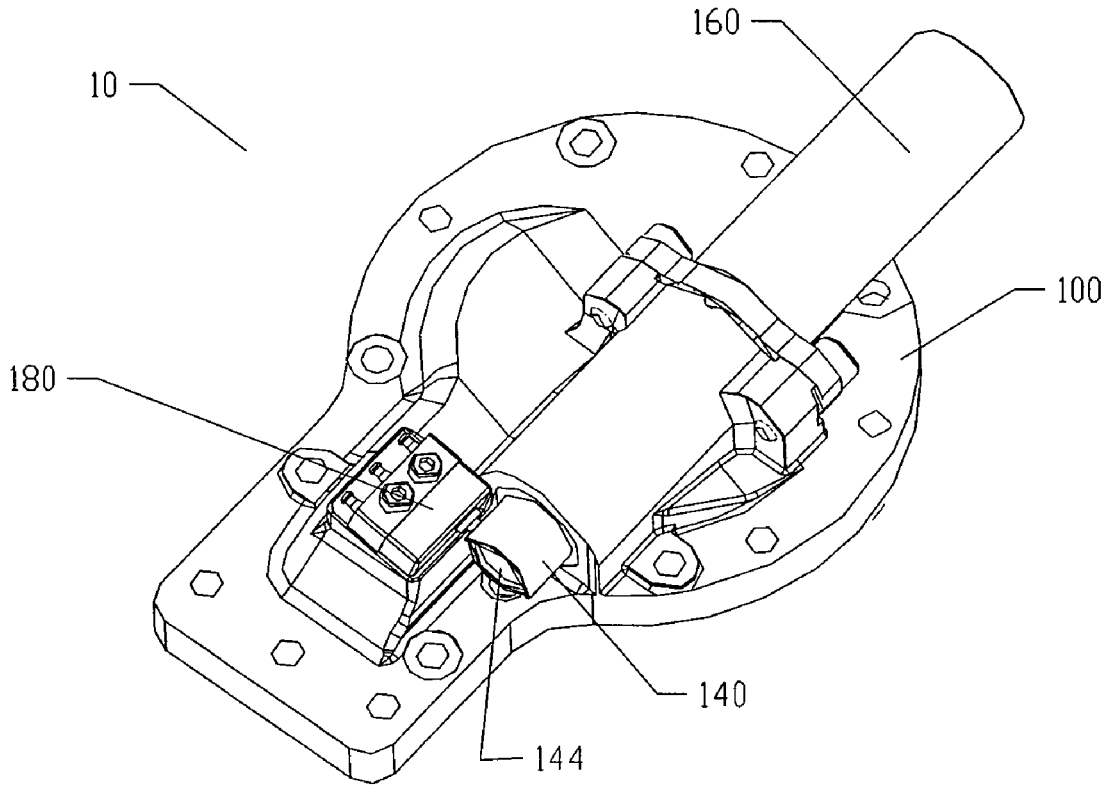
FIG. 1 shows a top view of an embodiment of the compression release valve.

FIG. 1 illustrates an embodiment of the invention, an electromechanical compression release valve, in the exemplary application for reducing the compression pressure in the cylinder head space of the Stirling engine. While the invention will be described generally with reference to an external combustion engine such as a Stirling cycle engine, it is to be understood that many engines, compressors, and other machines with rotary or reciprocating mechanisms, may similarly benefit from various embodiments and improvements that are subjects of the present invention. Like numbers in successive figures refer to the same or similar items.

Referring to FIG. 1, a top view of the electromechanical compression release valve is shown and designated generally by numeral 10. The compression release valve 10 comprises: a housing 100 with a chamber and an opening, valve member 140 with an inlet and outlet 144, valve-driving member 160, and a valve position sensor 180.

Figure 2:
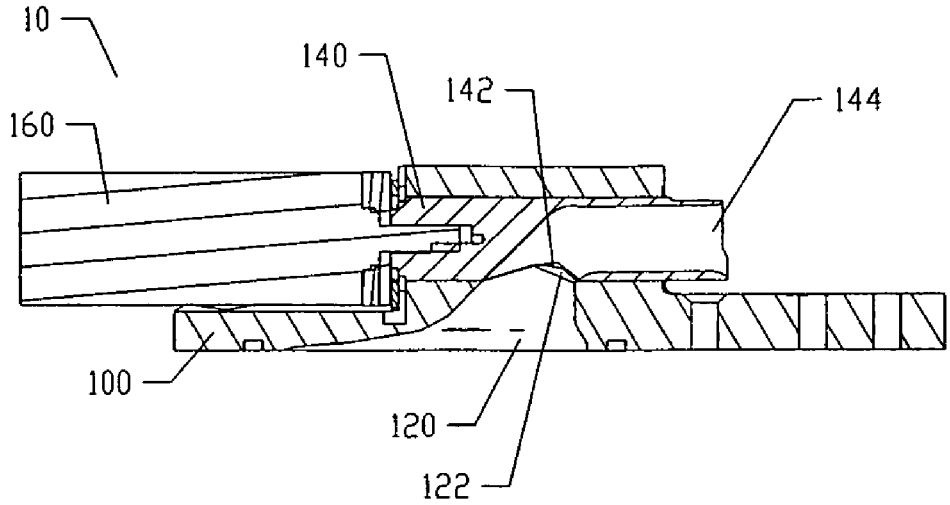
FIG. 2 shows the cross sectional view of an embodiment of the compression release valve of FIG. 1 in the open position.
Figure 3:
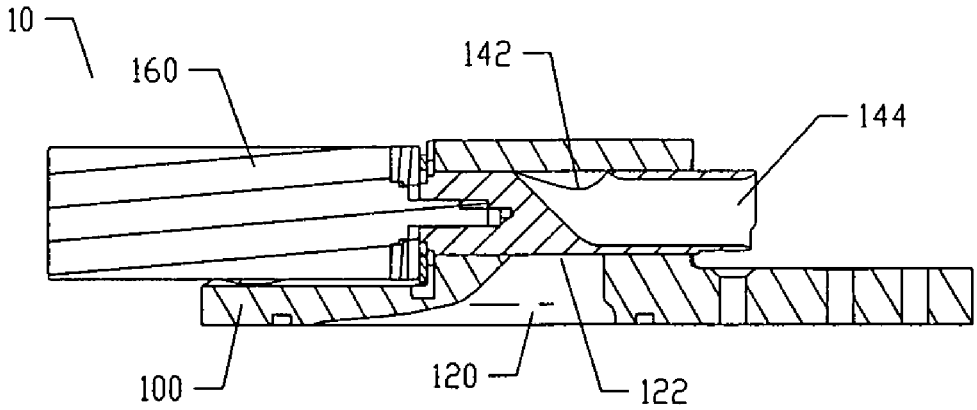
FIG. 3 shows the cross sectional view of an embodiment of the compression release valve of FIG. 1 in the closed position.

Referring now to FIGS. 1–3, which show several views of an embodiment of the invention, the compression release valve 10 in the open position reduces the Stirling starting power by reducing the compression pressure of the working fluid in the cylinder head area. The pressure reduction is achieved by passing the working fluid from the cylinder head space to another compartment such as the pressure vessel interior space or the crankcase. In the first or open position, and before starting the engine, the inlet 142 of the rotatable valve member 140 is aligned with the opening 122 in the chamber 120. The chamber 120 is in communication with the cylinder head space. The working fluid passes through the valve member 140 and the outlet 144 into the pressure vessel interior space. After the engine starts, the valve position sensor 180 senses the position of the valve member 140. The sensor 180 sends commands to a control unit, which directs the valve-driving member 160 to rotate the valve member 140 to the second or closed position. In the closed position, the inlet 142 is not aligned with the opening 122 and accordingly the vessel interior compartment is not in communication with the working fluid of the cylinder head space. The valve 10 is now closed and the working fluid in the cylinders can now achieve the operating compression pressures.

Housing

Referring to the embodiments shown in FIGS. 2 and 3, the housing 100 includes a chamber 120 that is in communication with the cylinder head space of the engine. The chamber 120 can be in communication with another engine compartment such as the crankcase when the valve 10 is open. The chamber 120 is shaped to permit the efficient transfer including high flow and low resistance, of the working fluid between the two compartments. In one embodiment, the housing 100 houses the valve member 140, the valve-driving member 160 and the valve position sensor 180. The housing 100 may be constructed from any material that can withstand the temperature variations and the attainable pressure in the cylinder head. Preferably, the housing 100 is constructed from aluminum to be relatively lightweight.

Figure 4:
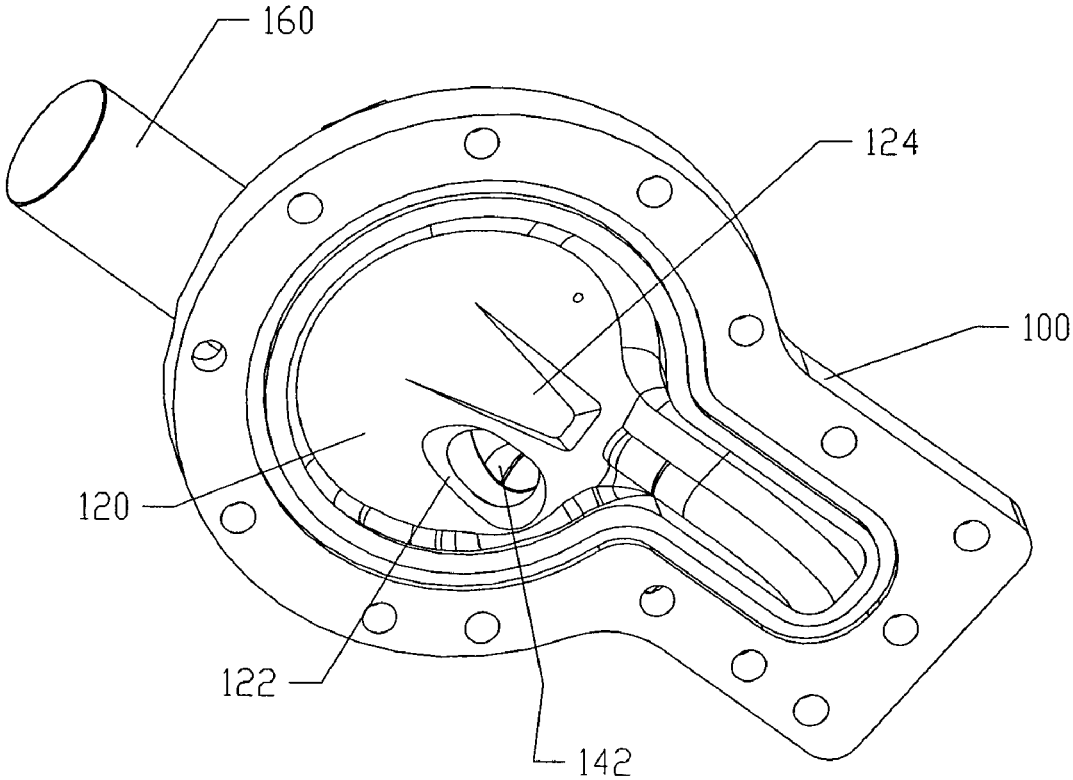
FIG. 4 shows the isometric view of an embodiment of the compression release valve where the inlet is not completely aligned with the opening.

In an embodiment of the invention, the geometry and location of the opening 122 in the chamber 120 can reduce the losses of the engine while starting, by providing a large area for the working fluid to efficiently pass through. In a preferred embodiment, the size of the opening 122, in combination with the inlet 142 of the valve member, minimizes the pressure drop as the working fluid passes through the valve member 140. Preferably, the opening 122 is placed close to the cylinder head to minimize the "dead" volume during engine operation. In one embodiment, the housing 100 is mounted to the engine cylinder head such that the chamber 120 is in communication with the engine space and the opening 122 is above the piston. In another embodiment, as shown in FIG. 4, flow control elements 124 such as protrusions and/or indentations are constructed in the chamber to facilitate the efficient and low resistance flow of the working fluid from the cylinder head space to the crankcase.

Valve Member

The valve member 140 as shown in FIGS. 1–3, comprises a hollow tube with one end blocked and an opening in the other end of the cylindrical surface. The valve member 140 is mounted inside a cylindrical portion of the housing 100 that is open on one end to accommodate the outlet 144 of the valve member. In an embodiment of the invention, there is a small clearance between the rotatable valve member 140 and the housing 100. In this embodiment, the clearance is about 508 micrometers. The clearance minimizes the leakage between the valve member 140 and the housing 100. Furthermore, the clearance eliminates the need for separate seals between the valve member 140 and the housing 100 to prevent leaking of the working fluid.

Preferably, the valve member is constructed from a material with a similar coefficient of thermal expansion as the housing to preserve the clearance between the valve member and the housing during the operation of the compression valve over a wide range of temperatures. Different coefficients of thermal expansion may result in different expansion rates over a temperature range. Wide or tight clearances may promote leakage or abrasion respectively.

To minimize leakage or abrasion, the bearing surfaces of the valve member or the housing may be different. In one embodiment, the valve member is modified to have a similar coefficient of thermal expansion but different frictional properties to the housing. In this embodiment, the valve member is modified with a thin layer of ceramic coating, instead of a lubricant, to ease its rotation in the housing. The ceramic coating material is RC70, commercially available from Pacific Bearing Products. Based on the high temperatures and pressures sustained by the compression release valve member, it is preferable to not use a wet lubricant in the rubbing surface between the valve member and the housing. Other embodiments may be lubricated if the lubricant does not interfere with the operation of the valve. Modifying the valve member by applying a thin layer of a different material to create a valve member with a substantially similar thermal coefficient of expansion but with different frictional properties from the housing, is a preferred method to manufacture the valve member.

Referring now to FIG. 2, the valve member 140 has an inlet 142. The inlet 142 is aligned with the chamber opening 122 to create the open valve position. In the open valve position and while the engine starts, the working fluid of the cylinder head passes through the inlet 142 of the valve member to the pressure vessel interior space via the outlet 144 of the valve member to reduce the compression pressure.

The outlet 144 opens into another area different from the cylinder head space. Preferably, the outlet 144 opens into the pressure vessel interior space in a Stirling engine, for example. Additionally, the dimensions of the outlet 144 may help reduce the losses of the engine while starting, by permitting the efficient transfer of materials between the two compartments. In a preferred embodiment, the dimensions and geometry of the inlet 142 and outlet 144 are determined to reduce the pressure difference across the valve member 140. Preferably, the end of the outlet 144 is chamfered to reduce the pressure difference across the valve and to enhance or control flow.

Referring to FIG. 3, after the engine starts, the valve 10 is closed. To close the valve, the valve-driving member 160 drives the valve member 140 such that the inlet 142 is no longer aligned with the opening 122 in the chamber. When the valve is closed, the working fluid cannot pass through the valve member 140. Accordingly working fluid in the cylinder head space may achieve the operating compression pressures for the engine to start producing work.

Valve-Driving Member

The valve-driving member 160 rotatably drives the valve member 140. The valve-driving member 160 may be a motor such as a step, servo or pneumatic motor, a linear actuator and a crank or rack and pinion, or a rotary solenoid, that can drive the valve member 140. In a preferred embodiment, as shown in FIGS. 2 and 3, the valve-driving member 160 is an electric DC motor. In this embodiment, the motor has an integral gearbox that is coupled to the closed end of the valve member 140 in the cylindrical portion of the housing 100. To close the valve 10, the motor 160 rotatably drives the valve member 140 such that the inlet 142 is not aligned with the opening 122 in the chamber of the housing. To open the valve, the electric motor rotates the valve member 140 such that the inlet 144 is aligned with the chamber opening 122 and the working fluid can pass through the valve member 140 via the outlet 144. Based on the design of the motor, gearbox, and drive circuit, the valve closing speed may be controlled.

Precise control of the rate of valve closing can prevent damage to the engine in certain applications. In the process of closing, the compression release valve should not trap an excessive amount of working fluid in the cylinders of the engine otherwise excessive pressure may damage or stall the engine. A way to avoid this problem is to close the valve slowly over a number of engine cycles, such that the excess working fluid escapes over several Stirling cycles. However, if the valve is closed too slowly, the energy stored in the rotating inertia of the Stirling mechanism can be consumed before the valve is fully closed causing the speed to drop low enough that the engine stalls. The precision control of the valve-driving member of this electromechanical compression release valve enables the valve to close at the appropriate speed over a number of engine cycles and avoid the problems described above.

Valve Position Sensor

In certain embodiments, the invention uses a sensor to control and monitor the position of the valve member 140. In a preferred embodiment, as shown in FIG. 1, the sensor is a valve position sensor 180. The valve position sensor 180 is a switch that opens an electrical circuit when the valve 10 is closed and closes the electrical circuit when the valve is open. When opening the valve, the control electronics apply a voltage to the valve-driving member 160 to drive the valve member 140 to rotate. When the valve member 140 reaches the open position, the switch closes and the control electronics drive the motor voltage to zero, thus, causing the valve member 140 to stop moving.

Based on the construction and general operation of electrical motors, there is a tendency for an electric motor to coast after the signal is switched off or the motor voltage is zero. This coasting may cause the valve member 140 to overshoot the open position. In other words, in the open position, the inlet 142 of the valve member may not correctly align with the chamber opening 122. To minimize valve open position overshoot, the control electronics generate a relatively low electrical resistance across the motor. This low electrical resistance, which may be a short circuit, creates a self-generated reverse current and reverse torque. Accordingly, the motor slows and stops relatively quicker than when a traditional stop command is sent, thus, the reverse current and the reverse torque enable a more precise control of the valve position.

In one embodiment as shown in FIG. 1, after opening, the valve position sensor 180 may determine the valve position and send commands to the associated components to close the valve 10. When closing the valve 10, the sensor switch 180 closes an electrical circuit and the control electronics direct the electric motor 160 to drive the valve member 140 until the switch opens. Preferably, the motor drives the valve member unidirectionally and the valve member stops when the electrical circuit opens. Alternatively, the motor may drive the valve member bi-directionally. The position where the valve member inlet 142 is not aligned with the chamber opening 122, as shown in FIG. 3, is the valve closed position. In one embodiment, the valve closed position is directly opposite the valve open position.

Figure 5A:
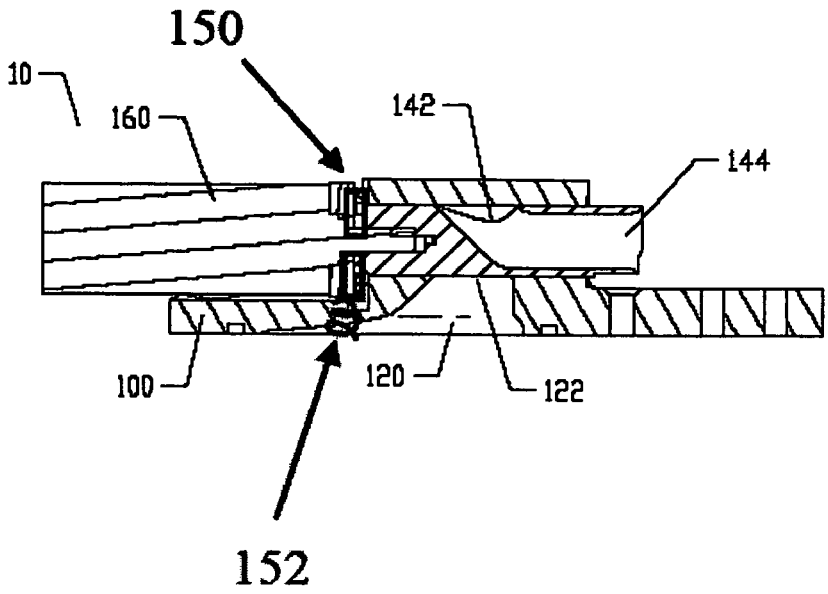
FIG. 5A shows the cross sectional view of an embodiment of the compression release valve of FIG. 1 in the closed position with the ratchet pawl.
Figure 5B:
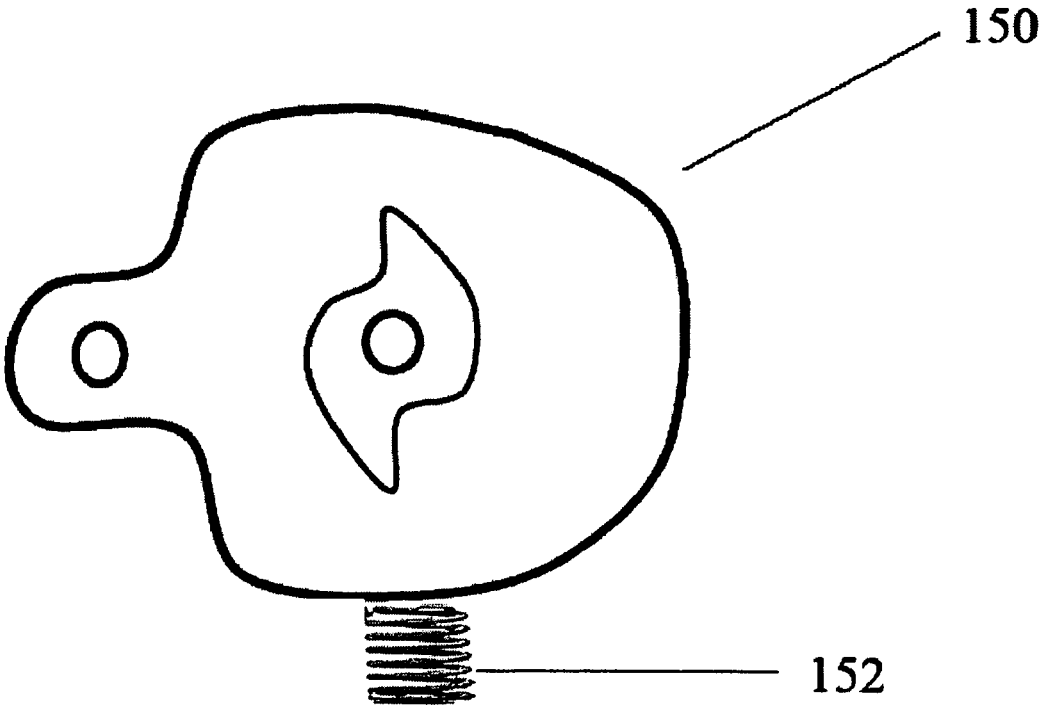
FIG. 5B shows a cross sectional view of an embodiment of the ratchet pawl.

To maintain the high efficiency and reduce losses to the engine, the valve should preferably remain in the closed position after the Stirling engine starts and during operation. While the compression valve may move to a random position or is likely to drift open due to engine vibration over a long period of operation, various embodiments of the present invention remain closed based on the presence of a ratchet pawl. In one embodiment as shown in FIGS. 5A and 5B, a ratchet pawl 150 is incorporated into the mechanism coupling the electric motor 160 to the valve member 140. In this embodiment, if the valve member 140 attempts to rotate in a reverse direction from the closed position, the ratchet pawl 150 can stop the motion before the valve member 140 moves. In this embodiment, after the valve member 140 reaches the closed position, the control electronics produce a relatively small reverse voltage across the electric motor 160. This reverse voltage causes the valve member 140 to move slowly backwards against the ratchet pawl 150. This slow movement reduces the deceleration that occurs when a valve is stopped by the ratchet pawl. The ratchet pawl 150 includes a return spring 152 as shown in FIG. 5A. Engaging the return spring 152 holds the ratchet pawl 150 in place. Accordingly, the ratchet pawl holds the valve member 140 in place and the valve 10 is likely to remain closed during a long period of engine operation and/or significant engine vibration.

In accordance with other embodiments of the invention where the valve-driving member can drive the valve member bi-directionally, hard mechanical stops may be used instead of the position switch and ratchet pawl 150. In this embodiment, the high deceleration forces that occur when the valve hits the stops may damage the valve or the valve-driving member. Thus, additional means, such as, a spring or an elastomeric damper, may be required to absorb the kinetic energy while limiting the mechanical stresses.

Compressor Application

In yet another embodiment, the compression release valve may be used in a compressor. Compressors typically have a reservoir of gas to fill. A relatively high pressure in the compressor reservoir requires a high starting torque. In this embodiment, the compression release valve in the open position connects the compression head to another compartment to reduce the compression pressure in the compressor head. Reducing the compression pressure in the compression head reduces the compressor starting torque. After starting the compressor, the compression release valve closes over a plurality of compressor cycles, to enable the compressor to fill the gas reservoir.

All of the systems and methods described herein may be applied in other applications, such as compressors, and other engines with rotary or reciprocating mechanisms, besides the Stirling or other thermal cycle engine in terms of which the invention has been described. The described embodiments of the invention are intended to be merely exemplary and numerous variations and modifications will be apparent to those skilled in the art. All such variations and modifications are intended to be within the scope of the present invention as defined in the appended claims.

We claim:

1. In an engine having a working space and a crankcase, an improvement comprising a valve controlling fluid flow between the working space and the crankcase, the valve including a valve member capable of rotation to a plurality of positions, a valve-driving member, and a controller in signal communication with the valve-driving member, wherein the valve-driving member is an electric motor and the controller is capable of generating a low electrical resistance across the motor for generating a reverse torque on the valve member, thus reducing overshoot for the valve member in rotating to a specified position.

2. An engine according to claim 1, wherein the valve further includes a ratchet pawl connected to the valve member for preventing movement of the valve member.

3. An engine according to claim 1, wherein the valve further includes a valve position sensor in signal communication with the controller.

4. A method for controlling compression in a thermal cycle engine comprising:

a. providing an engine having a working space and a crankcase, the engine including a valve controlling fluid flow between the working space and the crankcase, the valve including a valve member capable of rotation to a plurality of positions, a valve-driving member, and a controller in signal communication with the valve-driving member, wherein the valve-driving member is an electric motor and the controller is capable of generating a low electrical resistance across the motor for generating a reverse torque on the valve member;

b. generating a signal to the valve member to rotate to a specified position; and c. generating a low electrical resistance across the motor to reduce overshoot of the specified position.

5. A method according to claim 4, wherein generating the signal to the valve member to rotate the valve to a specified position includes a series of signals moving the valve member to intermediate positions.

6. A method according to claim 5, wherein generating the series of signals spans a plurality of engine cycles.

7. A method according to claim 4, wherein the valve member further includes a ratchet pawl, the method further including:

d. engaging the ratchet pawl to prevent movement of the valve member.

8. A method according to claim 4, wherein the engine is a Stirling engine.

9. A method for controlling compression in a thermal cycle engine comprising:

a. providing an engine having a working space and a crankcase, the engine including a valve controlling fluid flow between the working space and the crankcase, the valve including a valve member capable of rotation to a plurality of positions, a valve-driving member, and a controller in signal communication with the valve-driving member;

b. generating a signal to the valve member to rotate to a first position;

c. generating a signal reversing the direction of rotating the valve member;

d. continuing to rotate the valve member until the valve member encounters a stop; and e. retaining the valve member in a second position with the stop.

10. A method according to claim 9, wherein the stop is a ratchet pawl.

* * * * *